US005224078A

United States Patent [19]

Mallin

[11] Patent Number: 5,224,078

[45] Date of Patent: Jun. 29, 1993

[54] WATCH WITH CHANGEABLE TRANSPARENT FACE COVER

[76] Inventor: Mark Mallin, 24424 Plumtree Ct., West Hills, Calif. 91307

[21] Appl. No.: 811,369

[22] Filed: Dec. 20, 1991

[51] Int. Cl.[5] ..... G04B 19/00

[52] U.S. Cl. ..... 368/223; 368/281; 368/228

[58] Field of Search ..... 368/223-243, 368/77, 296, 276

[56] References Cited

U.S. PATENT DOCUMENTS

| | | | |
|---|---|---|---|
| 2,706,379 | 4/1955 | Fitzpatrick, Jr. | 58/88 |
| 2,804,746 | 9/1957 | Blumstein | 58/88 |
| 2,886,942 | 5/1959 | Stucky | 368/285 |
| 3,242,664 | 3/1966 | Lederrey | 58/88 |
| 3,269,108 | 8/1966 | Mottironi | 58/88 |
| 3,277,646 | 10/1966 | Howard, Sr. | 58/88 |
| 3,321,905 | 5/1967 | Krebs | 368/285 |
| 3,386,239 | 6/1968 | Shiffman | 368/285 |
| 3,555,812 | 1/1971 | Piquerez | 368/285 |
| 3,595,009 | 7/1991 | Pakter | 368/285 |
| 3,735,585 | 5/1973 | Takagi | 58/90 R |
| 3,777,475 | 12/1973 | Grossan | 58/126 B |
| 4,473,304 | 9/1984 | Ketner | 368/281 |
| 4,525,077 | 6/1985 | Ketner | 368/77 |
| 4,541,727 | 9/1985 | Rosenthal | 368/285 |
| 4,660,992 | 4/1987 | Paul et al. | 368/223 |
| 4,945,523 | 7/1990 | Lam | 368/285 |
| 5,008,869 | 4/1991 | Dweck | 368/228 |

*Primary Examiner*—Bernard Roskoski
*Attorney, Agent, or Firm*—John J. Posta, Jr.

[57] ABSTRACT

A watch is disclosed having a transparent member with decorative indicia thereon located between the interior of a removeable crystal member and the face of the watch. The transparent member is changeable to allow the appearance of the watch to be markedly changed, with the time being easily viewable through the transparent member. The invention is equally applicable to analog or digital watches, and to any configuration of watch case. In an alternate embodiment, the transparent member is installed for rotating movement driven by the watch movement.

18 Claims, 2 Drawing Sheets

WATCH WITH CHANGEABLE TRANSPARENT FACE COVER

BACKGROUND OF THE INVENTION

1. Field of the Invention

The present invention relates generally to watches, and more particularly to a watch having a transparent member with decorative indicia thereon for placement between the interior of a removeable crystal member and the watch face.

Watches have been used for the primary purpose of keeping time for many years, with the electronics revolution bringing the advent of highly precise watch movements which are available for very low prices. It has therefore not been surprising that the emphasis in watch design of late has been in the area of appearance of the watch rather than in the area of the watch mechanisms themselves. Recently, a number of watches have been successfully introduced which have interchangeable watch cases and bands to change the appearance of the watch.

The concept of using a single watch movement with different watch cases and bands is not new, having been illustrated in U.S. Pat. No. 2,706,379, to Fitzpatrick, Jr. forty years ago. However, while Fitzpatrick, Jr. was a high quality, high price device, the popular watches of today are fashion accessories which have much lower prices and typically use plastic materials to achieve a low manufacturing cost. While switchable watch cases and bands have proven extremely popular, they do not change the basic appearance of the watch itself, since the watch movement itself, including the watch face, is not changed at all by changing the case and the band.

One approach to changing the watch face is taught in U.S. Pat. No. 4,473,304 and in U.S. Pat. No. 4,525,077, both to Ketner. The Ketner references teach a toroid-shaped watch having a variety of decorative circular inserts which may be inserted into the interior of the toroid-shaped watch itself. The disadvantage of the Ketner references is that they require a toroid-shaped watch movement, which is not a standard watch configuration. Thus, production of the Ketner designs is not inexpensive, which represents a rather substantial disadvantage.

Another approach is to have replaceable watch face plates, which may be provided in a number of different designs to change the appearance of the watch. This approach is taught in U.S. Pat. No. 3,269,108, to Mottironi, and in U.S. Pat. No. 4,660,992, to Paul et al. The Mottironi device is elegant in its design, having a pair of interchangeable face plate halves which are spring-loaded to retain them in place. The Mottironi device has a singular disadvantage inherent to its design, which is the high degree of precision required to manufacture it. This unfortunately results in an elegant device which is expensive to manufacture.

The Paul et al. device has a hinged door which opens to allow a slotted face plate to be removably installed. The Paul et al. device is of simpler design than the Mottironi device, and it is easy to change face plates in the Paul et al. design. However, the slotted face plate is at least somewhat marred in its design by the existence of the slot. In addition, the Paul et al. design, like the Mottironi design, uses a removeable watch face plate, which requires that the stems upon which the watch hands are mounted be longer than a standard design, which results in additional cost due to the requirement that a non-standard watch movement be used.

Worth noting is a twist on this design as illustrated in U.S. Pat. No. 3,777,475, to Grossan. The Grossan reference uses a rotatable face plate mounted above a stationary face plate to count various diverse things such as medication, calories, cigarettes, etc. However, the Grossan face plates are not interchangeable or removeable, and thus are of little pertinence to the present invention.

The most recent design variation is illustrated in U.S. Pat. No. 5,008,869, to Dweck. The Dweck reference is truly unique in that it uses changeable opaque discs functioning as face plates which may be installed in a watch under a transparent liquid crystal watch display. The liquid crystal watch display is thus visible over the opaque discs. The Dweck reference thus successfully allows for the uses af changeable face plates, but with a liquid crystal watch display appearing on top of the face plates. Its primary disadvantage is that its construction is unconventional, and does not allow for the use of standard watch movements.

It is accordingly the primary objective of the present invention that it provide a novel watch design in which the appearance of the face of a watch using a conventional watch movement may be easily and conveniently changed. In addition, the present invention must also be capable of greatly changing the appearance of the watch, while simultaneously not impeding the ability of the wearer to see the time displayed on the watch. It is yet another objective of the present invention that the procedure required to change the appearance of the face of the watch be both easy and quick to accomplish, such that even a child may do it.

It is an additional objective of the present invention that it be equally applicable to the various designs of watches having a wide variety of different sizes and shapes. The design of the watch of the present invention must be relatively simple to keep its cost of manufacture low, while simultaneously being sufficiently rugged to assure the watch a long and trouble-free operating life. Finally, it is also an objective that all of the aforesaid advantages and objectives of the present invention be achieved without incurring any substantial relative disadvantage.

SUMMARY OF THE INVENTION

The disadvantages and limitations of the background art discussed above are overcome by the present invention. With this invention, the crystal of a watch is made to be easily and quickly removable. The watch itself may have any kind of conventional movement, either analog (having watch hands) or digital. In the preferred embodiment, the case of the watch is designed to accommodate the installation of a disc over the watch movement, with the disc being retained by the crystal when the crystal is replaced onto the watch movement.

The disc itself is transparent so that the watch movement may be clearly seen through the disc. The disc may carry indicia which does not obstruct the view of the watch movement sufficient to prevent the time from being read. For example, words, the outlines of pictures, or highly transparent pictures may be placed on the disc.

In the preferred embodiment, the watch case is circular to accommodate a circular crystal, which is screwed into the watch case to secure the disc. In alternate non-circular cases, the crystal may be hingedly mounted to the watch case. In another alternate embodiment, the disc may be inserted into the interior of the watch crystal.

Various other alternate embodiments are encompassed within the scope of the present invention. A disc may be made to be driven to rotate by the watch mechanism. In this case, two discs may be used if desired, with one rotating and the other remaining stationary. Other alternate embodiments use a partially opaque disc having a transparent window or an aperture therein to allow the watch display to be seen.

It may therefore be seen that the present invention teaches a novel watch design in which the appearance of the face of a watch using a conventional watch movement may be easily and conveniently changed. The watch of the present invention is capable of having a great variety of different appearances in its face, while simultaneously not impeding the ability of the wearer to see the time displayed on the watch. The procedure required to change the appearance of the face of the watch is both easy and quick to accomplish, such that even a child may accomplish it.

The principles of the present invention are equally applicable to the various designs of watches having a wide variety of different sizes and shapes. The design of the watch of the present invention is relatively simple to keep its cost of manufacture low, and yet is also sufficiently rugged to assure the watch a long and trouble-free operating life. Finally, all of the aforesaid advantages and objectives of the present invention are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

Figure 1:
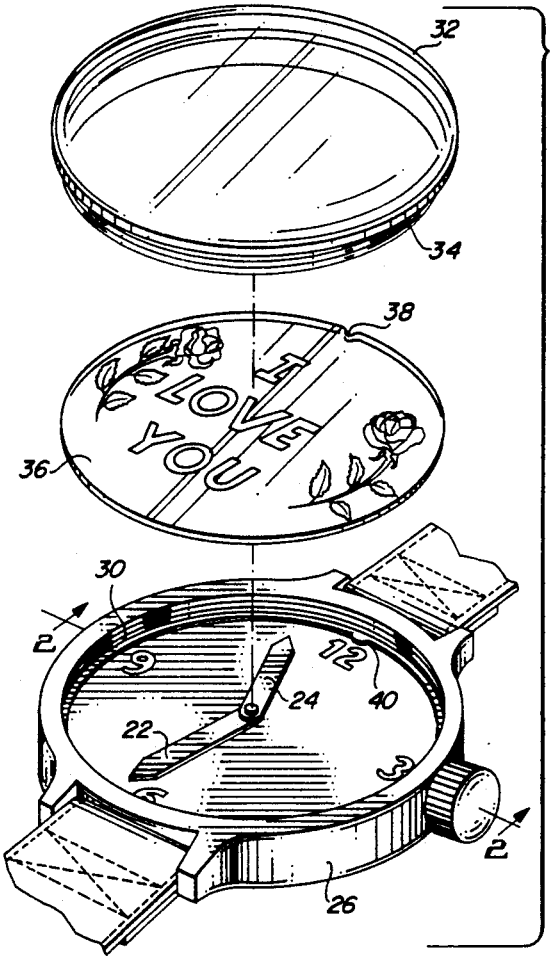
FIG. 1 is an exploded isometric view of the preferred construction of the present invention, in which a transparent disc having indicia thereon is retained in the top of a watch case over the watch movement by a crystal which is screwed onto the watch case.
Figure 2:
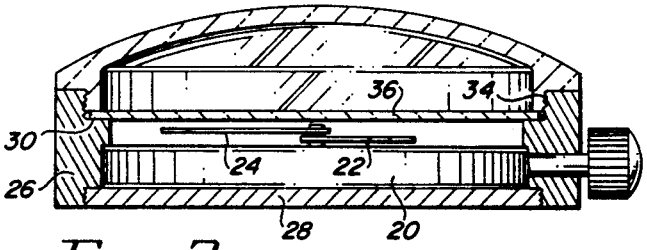
FIG. 2 is a cross-sectional view of the watch illustrated in FIG. 1, showing the manner in which the disc is retained between the watch crystal and the case.

The preferred embodiment is illustrated in FIGS. 1 and 2, which show a conventional analog watch movement 20 having an hour hand 22 and a minute hand 24, with the watch movement 20 being mounted in a watch case 26. The watch movement 20 illustrated in FIGS. 1 and 2 is of a circular configuration, and is of a standard design which is available from a wide variety of watch movement manufacturers throughout the world. The watch case 26 is also of circular configuration, and has a case back 28 installed thereon to retain the watch movement 20 inside the watch case 26 in a conventional manner.

The portion of the watch case located above the surface of the watch movement 20 is somewhat higher than in conventional designs, and has an annular shoulder 30 located in the interior side of the watch case 26 just over the level of the hour hand 22 and the minute hand 24. The portion of the interior of the watch case 26 below the annular shoulder 30 has a first smaller diameter, with the portion of the interior of the watch case 26 above the annular shoulder 30 having a second larger diameter.

The portion of the interior of the watch case 26 above the annular shoulder 30 which has the second larger diameter is also threaded to facilitate installation of a watch crystal 32, which is made in the preferred embodiment of transparent glass material. The watch crystal 32 has a cylindrical projection 34 extending from the bottom thereof. The outer diameter of the cylindrical projection 34 is threaded to fit into the threads located on the interior of the watch case 26 above the surface of the annular shoulder 30.

A thin transparent disc 36 having decorative indicia thereon is provided for location between the bottom of the cylindrical projection 34 of the watch crystal 32 and the shoulder 30 of the watch case 26. The diameter of the transparent disc 3 is just less than the diameter of the portion of the interior of the watch case 26 above the shoulder 30, which is the second larger diameter mentioned above. When the transparent disc 36 is installed into the watch case 26 so that it rests on the top of the annular shoulder 30 in the watch case 26, the bottom of the transparent disc 36 is located above and spaced away from the hour hand 22 and the minute hand 24.

In the preferred embodiment as best shown in FIG. 1, the transparent disc 36 has a small notch 38 located at an edge thereof. Located on top of the annular shoulder 30 at an edge thereof is a small pin 40 for engaging the notch 38 in the transparent disc 36 when the transparent disc 36 is placed in the watch case 26 on top of the annular shoulder 30. The notch 38 and the pin 40 provide a means of aligning the transparent disc 36 with respect to the watch case 26, and prevent the transparent disc 36 from rotating with respect to the watch case 26.

The watch crystal 32 is then screwed into the watch case 26 to retain the transparent disc 36 in position as shown in FIG. 2. If desired, a ring seal (not shown) may be used in conjunction with the watch crystal 32 to provide a sealing installation of the watch crystal 32 on the watch case 26.

Thus, the transparent disc 36 with its decorative indicia are located over the top of the watch movement 20 and the hour hand 22 and the minute hand 24. Since the transparent disc 36 is transparent, and since the decorative indicia o the transparent disc 36 do not obstruct the view of the watch movement 20, the time may be read through the transparent disc 36.

Figure 3:
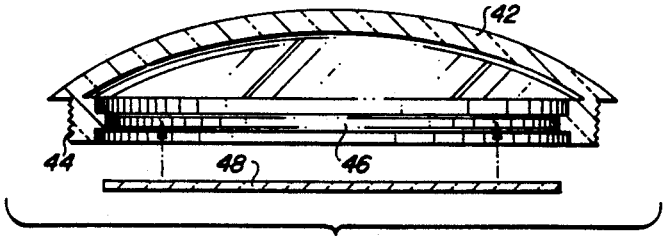
FIG. 3 is a cross-sectional view of an alternate embodiment watch crystal in which the disc is inserted into the interior of the watch crystal, where it is retained by a shoulder.

In FIG. 3, an alternate embodiment is illustrated in which a watch crystal 42 having a cylindrical projection 44 extending from the bottom thereof has a radially inwardly extending annular shoulder 46 located on the interior of the cylindrical projection 44. The exterior of the cylindrical projection 44 under the watch crystal 42 is again threaded. A transparent disc 48 may be inserted into the interior of the cylindrical projection 44 past the annular shoulder 46, with the annular shoulder 46 retaining the transparent disc 48 in position once it is so installed.

In this case, the watch crystal 42 would then be screwed into the watch case 26 of FIGS. 1 and 2 (instead of using the watch crystal 32 and the transparent disc 36). This would allow the portion of the interior of the watch case 26 below the annular shoulder 30 having the first smaller diameter to be lower than it is illustrated to be in FIGS. 1 and 2, with the transparent disc 48 still being located above and spaced away from the hour hand 22 and the minute hand 24.

Figure 4:
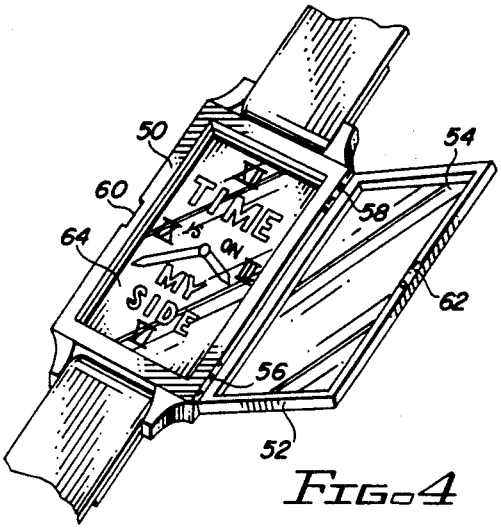
FIG. 4 is an isometric view of a construction of the present invention adaptable to watches having a non-circular case, in which a transparent disc having indicia thereon is retained in the top of a watch case over the watch movement by a hinged lid containing a crystal, with the lid being secured to the watch case by a locking mechanism.

Referring next to FIG. 4, an alternate embodiment similar to the device illustrated in FIGS. 1 and 2 is illustrated, but with a rectangular watch case 50. The rectangular watch case 50 has a hinged lid 52 containing a rectangular crystal 54, with the hinged lid 52 being attached to the rectangular watch case 50 by two hinges 56 and 58. The hinged lid 52 is secured in its closed position by a latch mechanism 60 mounted in the hinged lid 52 which engages a notch 62 located in the bottom of the hinged lid 52.

A transparent rectangular plate 64 fits into the top of the rectangular watch case 50 in a flush manner, with a shoulder (not shown) similar to the annular shoulder 30 (FIGS. 1 and 2) being used to support the transparent rectangular plate 64 above a watch movement located in the rectangular watch case 50 under the transparent rectangular plate 64.

In an embellishment possible only in watches having a circular case and crystal as in the design illustrated in FIGS. 1 and 2, an alternate embodiment of the present invention allows for the used of a transparent disc similar to the transparent disc 36, but which rotates. One such embodiment is illustrated in FIGS. 5 and 6, with a second embodiment being illustrated in FIGS. 7 and 8.

Figure 5:
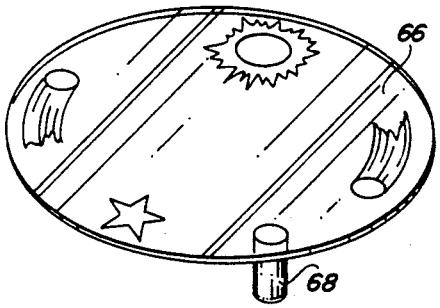
FIG. 5 is an isometric view of an alternate embodiment disc for rotatable installation in a watch, showing a pin mounted on the bottom of the disc near the outer radius of the disc.
Figure 6:
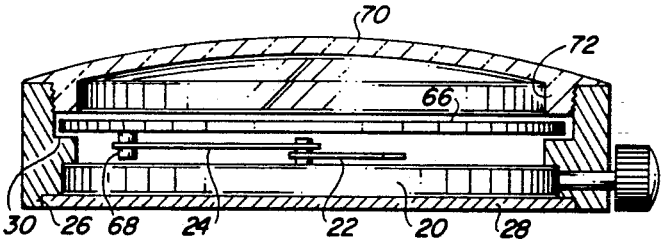
FIG. 6 is a cross-sectional view of a watch similar to that of FIG. 2, but with the disc of FIG. 5 installed in rotatable fashion for movement with the minute hand of the watch.

Turning first to FIGS. 5 and 6, a transparent disc 66 is illustrated which has a short pin 68 extending from the bottom thereof near the edge of the transparent disc 66. The transparent disc 66 has decorative indicia located thereon which does not obstruct the view through the transparent disc 66. The transparent disc 66 is installed in the watch case 26 having the watch movement 20 therein as shown in FIG. 6, just as the transparent disc 36 is installed in FIGS. 1 and 2, with the bottom of the transparent disc 66 being located above and spaced away from the hour hand 22 and the minute hand 24. The pin 68 contacts the minute hand 24 as shown in FIG. 6, and is located sufficiently far from the center of the transparent disc 66 to avoid contact with the hour hand 22.

A watch crystal 70 having a cylindrical projection 72 extending from the bottom thereof is used to cover the watch case 26 in the embodiment shown in FIG. 6. The cylindrical projection 72 of the watch crystal 70 is threaded on the outer diameter thereof, but the height of the cylindrical projection 72 is lower than the height of the cylindrical projection 34 of the watch crystal 32 in FIGS. 1 and 2.

Thus, when the watch crystal 70 is screwed into the watch case 26, the bottom of the cylindrical projection 72 will not contact the transparent disc 66. This allows the transparent disc 66 to be rotated freely, since it is not confined but is rather held for rotational movement. The movement of the minute hand 24 will thus cause the transparent disc 66 to rotate through the contact of the pin 68 by the minute hand 24.

Figure 7:
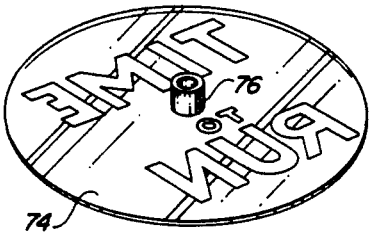
FIG. 7 is an isometric view from the bottom side of another alternate embodiment disc for rotatable installation in a watch, showing a tube mounted centrally on the bottom of the disc.
Figure 8:
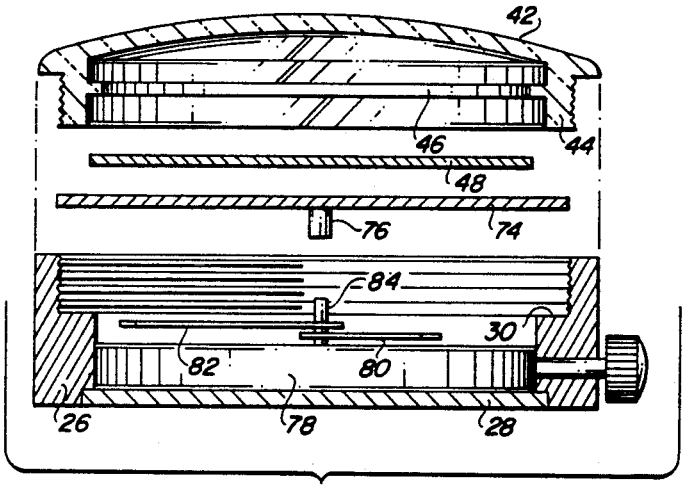
FIG. 8 is an exploded cross-sectional view of a watch similar to that of FIG. 2, but with the tube of the disc of FIG. 7 for installation on a rotating shaft extending from the watch movement.

Referring now to FIGS. 7 and 8, a transparent disc 74 is illustrated which has a short tube 76 extending from the bottom thereof in the center thereof. The transparent disc 74 has decorative indicia located thereon which does not obstruct the view through the transparent disc 74. Shown in FIG. 8 is the watch case 26 having a different watch movement 78 installed therein. The watch movement 78 has an hour hand 80 and a minute hand 82, and also has a rotating shaft 84 extending therefrom. The rotating shaft 84 would normally be used to drive a second hand (not shown or used herein).

The transparent disc 74 is installed into the watch case 26 with the tube 76 fitting in frictional contact over the rotating shaft 84 of the watch movement 78. In this position, the bottom of the transparent disc 74 will be located just spaced away from the annular shoulder 30. While the watch crystal 70 of FIG. 6 could be used to close the watch shown in FIG. 8, the watch crystal 42 of FIG. 3 is used instead to allow a second transparent disc to be used. Thus, the transparent disc 4 is installed into the interior of the cylindrical projection 44 past the annular shoulder 46, with the annular shoulder 46 retaining the transparent disc 48 in position once so installed.

The watch crystal 42 is then screwed into the watch case 26, with the bottom of the bottom of the cylindrical projection 44 not contacting the transparent disc 74. This allows the transparent disc 74 to rotated freely, since it is not confined but rather held for rotational movement. Thus, the watch shown in FIG. 8 thus has one rotating disc and one fixed disc. This allows a kaleidoscope effect to be created.

Figure 9:
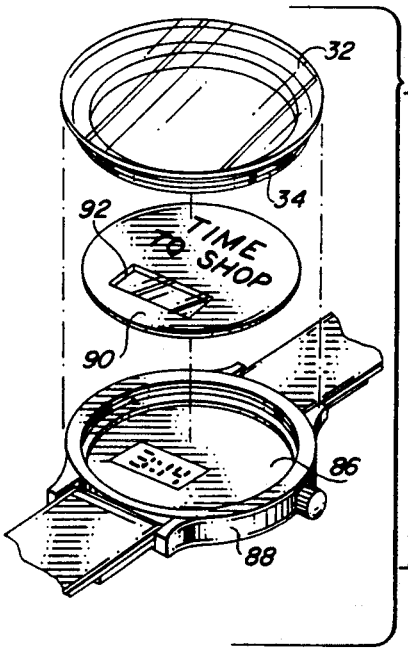
FIG. 9 is an exploded isometric view of another alternate embodiment using an opaque disc with a transparent window located therein.

Referring now to FIG. 9, a digital watch movement 86 is installed in a recessed manner into a watch case 88. An opaque disc 90 having a transparent window 92 therein is installed into the watch case 88 with the transparent window 92 located over the time display of the digital watch movement 86. Thus, the time display of the digital watch movement 86 is visible through the transparent window 92 in the opaque disc 90. The watch crystal 32 is then screwed into the watch case 88 to complete the construction of the watch shown in FIG. 9.

Figure 10:
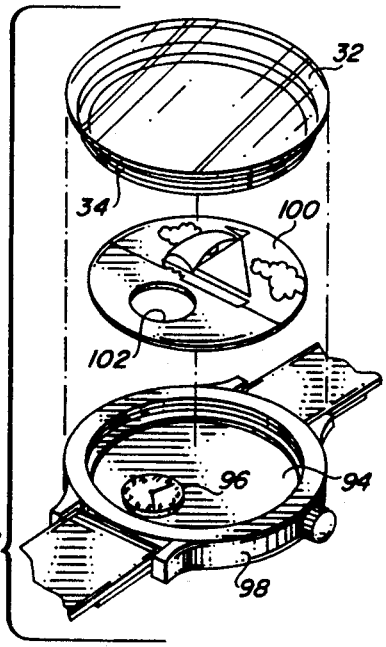
FIG. 10 is an exploded isometric view of another alternate embodiment using an opaque disc with an aperture located therein.

In FIG. 10, a variation of the watch shown in FIG. 9 is illustrated. An analog watch movement 94 having a protruding display portion 96 is installed into a watch case 98. An opaque disc 100 having an aperture 102 therein is installed into the watch case 98 with the aperture 102 fitting over the protruding display portion 96 of the analog watch movement 94. Thus, the time display of the analog watch movement 94 is visible through the aperture 102 in the opaque disc 100. The watch crystal 32 is then screwed into the watch case 98 to complete the construction of the watch shown in FIG. 10.

It may therefore be appreciated from the above detailed description of the preferred embodiment of the present invention that it teaches a novel watch design in which the appearance of the face of a watch using a conventional watch movement may be easily and conveniently changed. The watch of the present invention is capable of having a great variety of different appearances in its face, while simultaneously not impeding the ability of the wearer to see the time displayed on the watch. The procedure required to change the appearance of the face of the watch is both easy and quick to accomplish, such that even a child may accomplish it.

The principles of the present invention are equally applicable to the various designs of watches having a wide variety of different sizes and shapes. The design of the watch of the present invention is relatively simple to keep its cost of manufacture low, and yet is also sufficiently rugged to assure the watch a long and trouble-free operating life. Finally, all of the aforesaid advantages and objectives of the present invention are achieved without incurring any substantial relative disadvantage.

Although an exemplary embodiment of the present invention has been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A watch, comprising:

a watch case having a hollow interior, said watch case being open on a top side thereof;

a watch movement located in said hollow interior of said watch case in recessed fashion, said watch movement having means for displaying the time located on a top side thereof, said top side of said watch movement being visible through said top side of said watch case;

a shoulder located in said hollow interior of said watch case above said top side of said watch movement, said shoulder having a top side having a circular configuration;

an easily replaceable transparent disc having decorative indicia fixedly located thereon, said transparent disc resting on said top side of said shoulder, which shoulder thereby supports said transparent disc above said watch movement in a spaced away relationship; and a watch crystal having an interior side, said watch crystal for easily removable installation onto said top side of said watch case with said interior side of said watch crystal facing said top side of said watch movement, said transparent disc being located intermediate said interior side of said watch crystal and said shoulder of said watch case, said means for displaying the time being visible through said watch crystal and said transparent disc.

2. A watch as defined in claim 1, wherein said watch movement is a digital watch movement.

3. A watch as defined in claim 1, wherein said watch movement is an analog watch movement.

4. A watch as defined in claim 1, wherein said watch crystal comprises:

a cylindrical projection extending from the bottom of said watch crystal, said cylindrical projection being located inside said hollow interior of said watch case when said watch crystal is installed onto said watch case, said cylindrical projection retaining said transparent disk in position on said shoulder.

5. A watch as defined in claim 4, additionally comprising:

means for aligning said transparent disc with respect to said watch case and for preventing the rotation of said transparent disc with respect to said watch case.

6. A watch as defined in claim 5, wherein said preventing means comprises:

a notch located in the edge of said transparent disc; and a pin located on said top of said shoulder at an edge thereof, said pin for engaging said notch in said transparent disc when said transparent disc is placed in said watch case on said top side of said shoulder.

7. A watch as defined in claim 4, wherein the portion of said hollow interior of said watch case above said shoulder has female threads located therein, and wherein the exterior of said cylindrical projection extending from the bottom of said watch crystal has male threads located thereon, said male threads on said cylindrical projection being engageable with said female threads in said watch case to secure said watch crystal to said watch case.

8. A watch as defined in claim 4, wherein said transparent disc is rotatably mounted, said watch additionally comprising:

means for rotating said transparent disc.

9. A watch as defined in claim 8, wherein said means for rotating said transparent disc comprises:

a pin extending from the bottom of said transparent disc near the edge of said transparent disc, said pin for engagement by one of a plurality of hands of said watch movement to rotate said transparent disc.

10. A watch as defined in claim 8, wherein said means for rotating said transparent disc comprises:

means for rotating a shaft extending from said top side of said watch movement at a central location thereon; and a sleeve extending from the bottom of said transparent disc at the center thereof, said sleeve for engagement with said shaft extending from said top side of said watch movement.

11. A watch as defined in claim 8, additionally comprising:

a second transparent disc having decorative indicia located thereon, said second transparent disc for stationary installation intermediate said interior side of said watch crystal and said transparent disc.

12. A watch as defined in claim 1, wherein said means for supporting said transparent member comprises:

a cylindrical projection extending from the bottom of said watch crystal, said cylindrical projection being located inside said hollow interior of said watch case when said watch crystal is installed onto said watch case; and an inwardly extending annular shoulder located on the interior of said cylindrical projection extending from the bottom of said watch crystal, said inwardly extending annular shoulder retaining said transparent disk in position inside said cylindrical projection when said transparent disk is initially so installed.

13. A watch as defined in claim 1, wherein said transparent member comprises:

an opaque member having a transparent portion therein, said transparent portion of said opaque member being located over said means for displaying the time.

14. A watch as defined in claim 1, wherein said transparent member comprises:

an opaque member having an aperture located therein, said aperture in said opaque member being located over said means for displaying the time.

15. A watch as defined in claim 1, additionally comprising:

at least one additional easily replaceable transparent disc having decorative indicia fixedly located thereon, said at least one additional easily replaceable transparent disc for interchangeable substitution for said easily replaceable transparent disc between said interior side of said watch crystal and said shoulder of said watch case.

16. A method of making a watch, comprising:

providing a watch case having a hollow interior, said watch case being open on a top side thereof;

installing a watch movement in said hollow interior of said watch case in recessed fashion, said watch movement having means for displaying the time located on a top side thereof, said top side of said watch movement being visible through said top side of said watch case, a shoulder being located in said hollow interior of said watch case above said top side of said watch movement, said shoulder having a top side having a circular configuration; and securing a watch crystal having an interior side onto said top side of said watch case in an easily removable manner with said interior side of said watch crystal facing said top side of said watch movement, and with a replaceable transparent disc having decorative indicia fixedly located thereon located intermediate said interior side of said watch crystal and said shoulder of said watch case, said transparent disc resting on said top side of said shoulder, which shoulder thereby supports said transparent disc above said watch movement in a spaced away relationship, said means for displaying the time being visible through said watch crystal and said transparent disc.

17. A watch, comprising:

a watch case having a hollow interior, said hollow interior of said watch case being of circular configuration, said watch case being open on a top side thereof;

a watch movement located in said hollow interior of said watch case in recessed fashion, said watch movement having means for displaying the time located on a top side thereof, said top side of said watch movement being visible through said top side of said watch case;

a transparent disc having decorative indicia located thereon;

a shoulder located in said hollow interior of said watch case above said top side of said watch movement, said shoulder having a top side for supporting said transparent disc above said watch movement in a spaced away relationship, said transparent disc resting on said top side of said shoulder;

a watch crystal having an interior side, said watch crystal for installation onto said top side of said watch case with said interior side of said watch crystal facing said top side of said watch movement, a cylindrical projection extending from the bottom of said watch crystal, said cylindrical projection being located inside said hollow interior of said watch case when said watch crystal is installed onto said watch case, said cylindrical projection retaining said transparent disk in position on said shoulder, said transparent disc being located intermediate said cylindrical projection of said watch crystal and said shoulder of said watch case, said means for displaying the time being visible through said watch crystal and said transparent disc; and a pin extending from the bottom of said transparent disc near the edge of said transparent disc, said pin for engagement by one of a plurality of hands of said watch movement to rotate said transparent disc.

18. A watch as defined in claim 17, additionally comprising:

a second transparent disc having decorative indicia located thereon, said second transparent disc for stationary installation intermediate said interior side of said watch crystal and said transparent disc.

* * * * *